US011891580B2

(12) United States Patent
Janssen et al.

(10) Patent No.: US 11,891,580 B2
(45) Date of Patent: Feb. 6, 2024

(54) MICROCRYSTALLINE WAX

(71) Applicant: SHELL OIL COMPANY, Houston, TX (US)

(72) Inventors: Andries Hendrik Janssen, Amsterdam (NL); Gerrit Leendert Bezemer, Amsterdam (NL); Edward Julius Creyghton, Amsterdam (NL); Guy Lode Magda Maria Verbist, Amsterdam (NL); Pim Lohmeijer, Eindhoven (NL); Christina Georgieva Christova-Zdravkova, Eindhoven (NL)

(73) Assignee: SHELL USA, INC., Houston, TX (US)

( * ) Notice: Subject to any disclaimer, the term of this patent is extended or adjusted under 35 U.S.C. 154(b) by 20 days.

(21) Appl. No.: 17/629,228

(22) PCT Filed: Aug. 3, 2020

(86) PCT No.: PCT/EP2020/071777
§ 371 (c)(1),
(2) Date: Jan. 21, 2022

(87) PCT Pub. No.: WO2021/023700
PCT Pub. Date: Feb. 11, 2021

(65) Prior Publication Data

US 2022/0267684 A1 Aug. 25, 2022

(30) Foreign Application Priority Data

Aug. 8, 2019 (EP) ..... 19190872

(51) Int. Cl.
*C10G 73/44* (2006.01)
*C10G 45/64* (2006.01)

(52) U.S. Cl.
CPC ..... *C10G 73/44* (2013.01); *C10G 45/64* (2013.01); *C10G 2300/1022* (2013.01)

(58) Field of Classification Search
CPC ..... C10G 45/64; C10G 73/42; C10G 73/44
See application file for complete search history.

(56) References Cited

U.S. PATENT DOCUMENTS

| | | | |
|---|---|---|---|
| 5,904,834 | A | 5/1999 | Ansorge et al. |
| 6,776,898 | B1 | 8/2004 | Wittenbrink et al. |
| 7,300,565 | B2 | 11/2007 | Hoek |
| 9,896,632 | B2 | 2/2018 | Janssen et al. |
| 9,918,946 | B2 | 3/2018 | Bekker et al. |
| 2004/0092382 | A1 | 5/2004 | John et al. |
| 2004/0192979 | A1 | 9/2004 | Matthai et al. |
| 2004/0199040 | A1 | 10/2004 | Hoek et al. |
| 2006/0118462 | A1* | 6/2006 | Schulze-Trautmann ..... C10G 45/58 208/20 |
| 2007/0158237 | A1 | 7/2007 | Adams et al. |
| 2007/0193923 | A1 | 8/2007 | Dierickx et al. |
| 2017/0369799 | A1 | 12/2017 | Hoek et al. |

FOREIGN PATENT DOCUMENTS

| | | | |
|---|---|---|---|
| EP | 1509583 | A1 | 3/2005 |
| WO | 02096842 | A2 | 12/2002 |
| WO | 02102941 | A2 | 12/2002 |

OTHER PUBLICATIONS

International Search Report and Written Opinion received for PCT Patent Application No. PCT/EP2020/071777, dated Nov. 30, 2020, 09 pages.

* cited by examiner

*Primary Examiner* — Renee Robinson
(74) *Attorney, Agent, or Firm* — SHELL USA, INC.

(57) ABSTRACT

The present invention provides a microcrystalline wax having a needle penetration according to ASTM D-1321 at 25° C. of more than 1, a crystallinity according to XRD between 5 and 70%, an initial boiling point of less than 500° C., a congealing point in the range of from 60 to 120° C., an oil content according to ASTM D-721 of more than 2 wt. %, wherein the microcrystalline wax has a fraction up to C40 having at least 5 wt % of multiple methyl-branched paraffins as determined with GC×GC.

7 Claims, 2 Drawing Sheets

Figure 1: Boiling point distributions
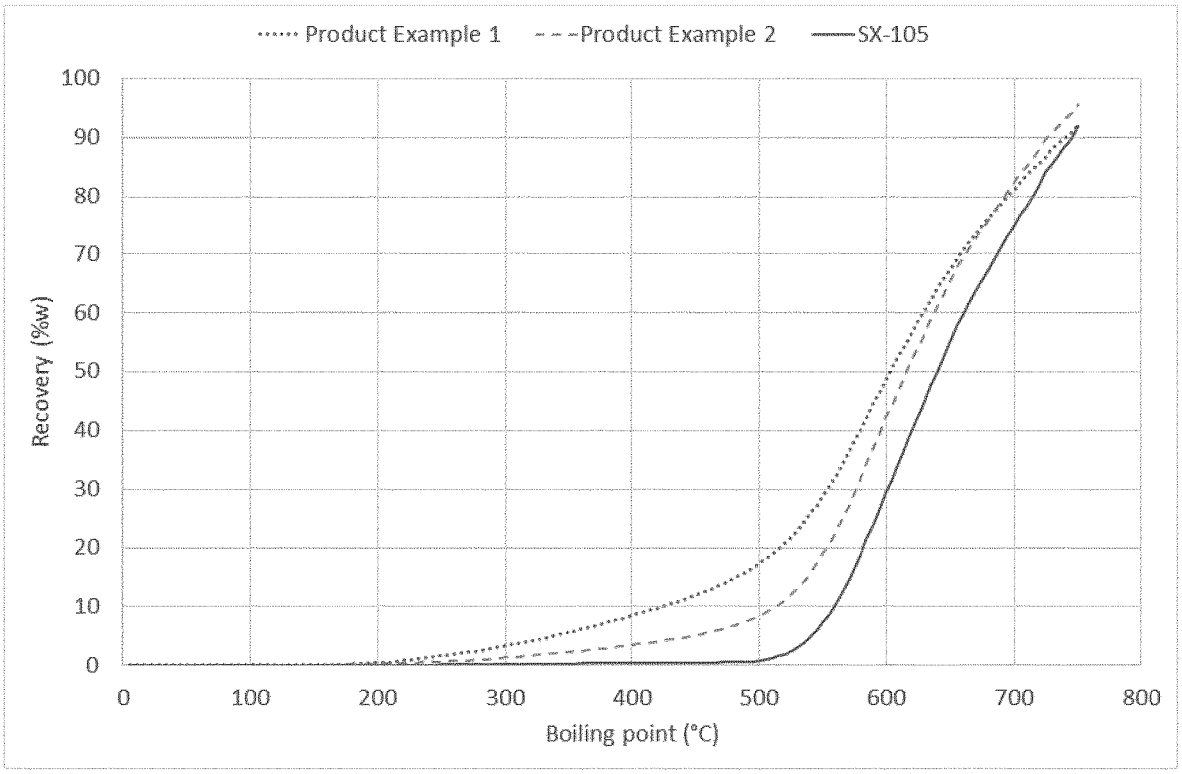

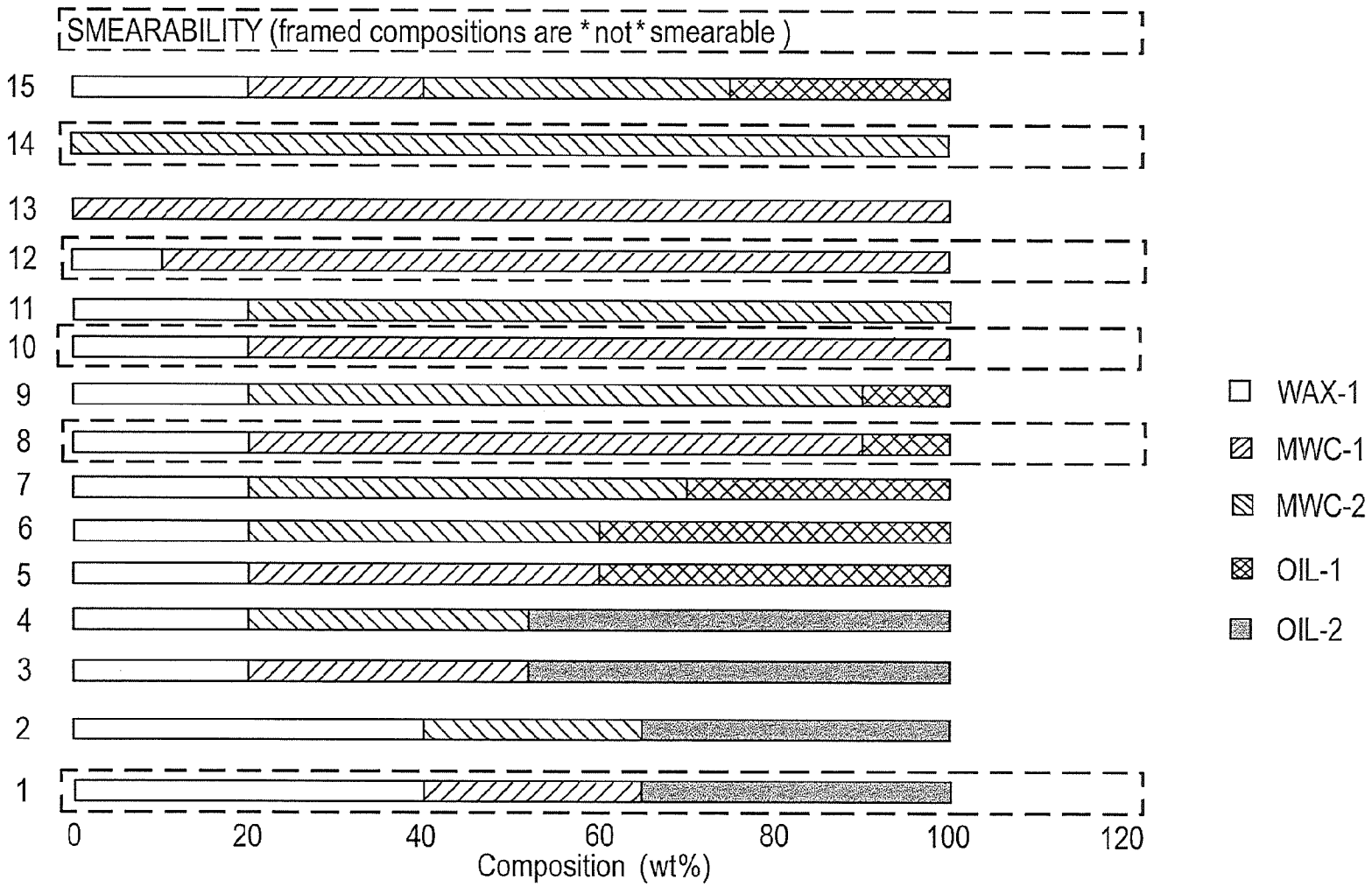
Fig.2 Smearability of petroleum jelly compositions

MICROCRYSTALLINE WAX

CROSS REFERENCE TO RELATED APPLICATIONS

This is a National stage application of International application No. PCT/EP2020/071777, filed Aug. 3, 2020, which claims priority of EP application No. 19190872.2, filed 8 Aug. 2019 which is incorporated herein by reference in its entirety.

FIELD OF THE INVENTION

The present invention is directed to a microcrystalline wax, a process to prepare a microcrystalline wax, a petroleum jelly comprising a microcrystalline wax and the use of a microcrystalline wax in petroleum jelly, hot melt adhesives, as gloss improver, car and shoe polishes, and as protection for emulsions and PVC reactors.

BACKGROUND TO THE INVENTION

It is known to prepare a microcrystalline wax by means of solvent dewaxing of a petroleum residue fraction from vacuum distillation. The production of microcrystalline wax is typically associated with plants that produce Group I base oils. Examples of such processes are described in Ullman's Encyclopedia of Industrial Chemistry, Wiley-VDH Verlag, 2000. These microcrystalline wax can contain a significant fraction boiling above 750° C.

A problem of the process to produce microcrystalline wax from petroleum residue is that, although this process delivers microcrystalline wax with suitable properties for many applications, they do contain impurities like (poly)aromatics, sulfur, nitrogen and oxygen compounds. Moreover, closure of Group I base oil complexes due to lower demand for these base oils will result in lower production of microcrystalline wax from petroleum residues.

It is also known to prepare wax from the product obtained from the Fischer-Tropsch process as for example described in WO02/096842 A2. WO02/096842 A2 discloses a process for the preparation of a microcrystalline wax from a starting material having carbon atoms in the range of from 20 to 105. The microcrystalline waxes from WO02/096842 A2 have a high oil content and a small amount of multiple methyl branched paraffins (in other words no highly branched isoalkanes).

A problem of the process as disclosed in WO02/096842 A2 is that although this process delivers microcrystalline waxes, microcrystalline waxes having molecules with carbon numbers above 120 are not produced. Moreover, with the process disclosed in WO02/096842 A2 microcrystalline waxes with a small amount of multiple methyl branched paraffins (in other words no highly branched isoalkanes) are obtained. Multiple methyl branched paraffins may assist in good oil binding capacity of microcrystalline wax in applications such as petroleum jelly.

EP 1 409 613B1 discloses a process to prepare a microcrystalline wax by contacting under hydroisomerisation conditions a feed, comprising at least 80 wt. % of normal paraffins, with a catalyst comprising a noble metal and a porous silica-alumina carrier.

A problem of the process as disclosed in EP 1 409 613 is that the microcrystalline wax is obtained by hydroiosmerisation of the entire wax product obtained in the Fischer-Tropsch synthesis. As a result, the production of other Fischer-Tropsch derived products is excluded by the process disclosed in EP 1 409 613. Moreover, a microcrystalline wax with a congealing point in the range of 95-120 is being obtained.

SUMMARY OF THE INVENTION

It is an object of the invention to solve or minimize at least of one of the above problems.

It is a further object of the invention to provide a microcrystalline wax which can advantageously be used in applications such as petroleum jelly, hot melt adhesives, as gloss improvers, car and shoe polishes and as protection for emulsions and PVC reactors.

Moreover, it is an object of the present invention to provide an efficient method for preparing microcrystalline waxes having molecules with carbon numbers above 120 and a high amount of multiple methyl branched paraffins.

One of the above or other objects may be achieved according to the present invention by providing a microcrystalline wax having a needle penetration according to ASTM D-1321 at 25° C. of more than 1, a crystallinity according to XRD between 5 and 70%, an initial boiling point of less than 500° C., a congealing point in the range of from 60 to 120° C., an oil content according to ASTM D-721 of more than 2 wt. %, wherein the microcrystalline wax has a fraction up to C40 having at least 5 wt % of multiple methyl-branched paraffins as determined with GC×GC.

It has now surprisingly been found according to the present invention that the microcrystalline wax may be advantageously used in several microcrystalline wax applications.

An important advantage of the present invention is that the microcrystalline wax may be advantageously used in applications such as petroleum jelly, hot melt adhesives, as gloss improvers, car and shoe polishes and as protection for emulsions and PVC reactors. The high carbon chain length distribution and the high amount of multiple methyl branched paraffins of the microcrystalline wax results in less use of additional components in the different applications.

In addition, the microcrystalline wax has a high melting point, and high needle penetration which makes the microcrystalline paraffin a perfect candidate for being used in hot melt adhesives.

As explained above an important advantage of the present invention is that the microcrystalline wax having molecules with a carbon number above 120 and a high amount of multiple methyl branched paraffins results in good oil binding capacity when used in microcrystalline wax applications such as petroleum jelly where it is being combined with oil and wax.

In another embodiment of the present invention there is provided a process to prepare a microcrystalline wax. An advantage of said process according to the present invention is that production of the microcrystalline wax does not need to go at the expense of other Fischer-Tropsch derived products because the microcrystalline wax is not prepared from hydroisomerisation of the entire wax product obtained in the Fischer-Tropsch synthesis but from a Fischer-Tropsch derived wax fraction with a congealing point between 60 and 120° C., while the congealing point of the obtained microcrystalline wax can be below 95° C. In contrast to the preparation of crude oil derived microcrystalline waxes, with the process according to the present invention the isomerization grade of the microcrystalline waxes can be tuned.

A further advantage is that Fischer-Tropsch waxes for which no outlets can be found can now be converted into the high value microcrystalline waxes.

In a further embodiment of the present invention there is provided a petroleum jelly comprising a Fischer-Tropsch microcrystalline wax according to the present invention, further containing a Fischer-Tropsch derived wax and a Fischer-Tropsch derived waxy raffinate. An advantage of said petroleum jelly is that it is an all-GTL petroleum jelly with very low contaminant levels, which is key for cosmetic applications.

BRIEF DESCRIPTION OF THE DRAWINGS

The drawing figures depict one or more implementations in accord with the present teachings, by way of example only, not by way of limitation. In the figure, like reference numerals refer to the same or similar elements.

FIG. 1 is the boiling point distribution of a Fischer-Tropsch wax with a congealing point of 105° C., of a product obtained by hydroisomerisation at a temperature of 317° C. and a product obtained by hydroisomerisation at a temperature of 340° C. FIG. 2 is the smearability of several petroleum jelly compositions.

DETAILED DESCRIPTION OF THE INVENTION

The present disclosure is not limited to the embodiments as described above and the appended claims. Many modifications are conceivable and features of respective embodiments may be combined.

According to the present invention, microcrystalline wax having a needle penetration according to ASTM D-1321 at 25° C. of more than 1, a crystallinity according to XRD between 5 and 70%, an initial boiling point of less than 500° C., a congealing point in the range of from 60 to 120° C., an oil content according to ASTM D-721 of more than 2 wt. %, wherein the microcrystalline wax has a fraction up to C40 having at least 5 wt % of multiple methyl-branched paraffins as determined with GC×GC.

The microcrystalline wax comprises primarily paraffins. The microcrystalline wax according to the present invention comprises more than 40 wt. % of isoparaffins, preferably more than 60 wt. % of isoparaffins.

Microcrystalline waxes are known and described for example in WO02/096842 A2 and in EP1409613 B 1.

Preferably, the fraction up to C40 of the microcrystalline wax has at least 5 wt % of multiple methyl-branched paraffins as determined with GC×GC. Suitably, said fraction having a carbon chain length of up to C40 has at least 10 wt % of multiple methyl-branched paraffins and less than 90 wt. %, preferably less than 80 wt. % of multiple methyl branched paraffins as determined with GC×GC. The fraction up to C40 is preferably a fraction with a carbon chain length between C8 and C40.

Also, the microcrystalline wax according to the present invention has a needle penetration according to ASTM D-1321 at 25° C. of more than 1. Preferably, the microcrystalline wax according to the present invention has a needle penetration according to ASTM D-1321 at 25° C. more than 10, more preferably 20, up to more than 250. A needle penetration of up to 250 is indicated for the microcrystaline wax according to the present invention because 250 is the limit of ASTM D-1321.

Further, the microcrystalline wax according to the present invention has a crystallinity according to XRD is between 5 and 70%, preferably between 5 and 60%, more preferably between 10 and 50%, even more preferably between 10 and 30%.

Preferably, the microcrystalline wax according to the present invention has an initial boiling point of more than 100° C. Suitably, the microcrystalline wax according to the present invention has an initial boiling point above 150° C., preferably above 175° C. and more preferably above 200° C. The final boiling point of the microcrystalline wax according to the present invention is above 730° C., preferably above 750° C. The final boiling point of the microcrystalline wax relates to the boiling point of the molecule in the microcrystalline wax with a carbon number of 105 (730° C.) and 120 (750° C.), respectively.

Also, microcrystalline wax according to the present invention, has a congealing point in the range of from 60 to 120° C. Preferably the microcrystalline wax according to the present invention has a congealing point in the range of from 60 to 105° C., more preferably 60 to 95° C. and even more preferably 60 to 85° C. according to ASTM D-938.

Further, the microcrystalline wax according to the present invention has a proportion by weight of isoalkanes which is greater than that of n-alkanes.

Suitably, the amount of isoalkanes is more than 40 wt. % based on the total amount of paraffins. In contrast to crude oil derived microcrystalline waxes, the microcrystalline waxes according to the present invention has a very low amount of naphthenes and aromatics.

The microcrystalline wax has a kinematic viscosity at 100° C. according ASTM D445 above 12 cSt, preferably in a range of from 12 to 30 cSt. In a specific embodiment, the microcrystalline wax has a kinematic viscosity at 100° C. according to ASTM D445 between 18 and 30 cSt.

It is preferred that the microcrystalline wax according to the present invention is a Fischer-Tropsch derived microcrystalline wax.

The Fischer-Tropsch derived microcrystalline wax is derived from a Fischer-Tropsch process. Fischer-Tropsch product stream is known in the art. By the term "Fischer-Tropsch derived" is meant a microcrystalline wax is, or is derived from a Fischer-Tropsch process. A Fischer-Tropsch derived microcrystalline wax may also be referred to a GTL (Gas-to-Liquids) product. An example of a Fischer-Tropsch process is given in WO2002/102941, EP 1 498 469 and WO2004/009739, the teaching of which is incorporated by reference.

In a further aspect, the present invention provides a process for preparing a microcrystalline wax, the process at least comprising the following steps:

(a) providing a FT wax having a carbon chain length distribution in the range of from 20 to above 120 and a crystallinity according to XRD of more than 75%, wherein at least 1 wt. % of the FT wax has a carbon chain length of more than 120;

(b) subjecting the FT wax to a isomerization step at temperatures in the range of from 200 to 400° C. and a pressure between 1 to 25 Mpa, and a WHSV between 0.1 and 5 kg/l/h, using a catalyst comprising a molecular sieve with a pore size between 5 and 7 angstrom and a $SiO_2/AlO_3$ ratio of at least 25, preferably from 50 to 180 and a group VIII metal to obtain a microcrystalline wax having a needle penetration according to ASTM D-1321 at 25° C. of more than 1, a crystallinity according to XRD between 5 and 70%, an initial boiling point of less than 500° C., a congealing point in the range of from 60 to 120° C., an oil content according to ASTM D-721 of more than 2 wt. %, wherein the microcrystalline wax has a fraction up to C40 having at least 5 wt % of multiple methyl-branched paraffins as determined with GC×GC.

In step (a) of the process according to the present invention a Fischer-Tropsch wax having a carbon chain length distribution in the range of from 20 to above 120 and a crystallinity according to XRD of >75 is provided. By the part "having a carbon chain length distribution in the range of from 20 to above 120" is meant having molecules with a carbon number in the range of from 20 to above 120 carbon atoms per molecule. Preferably, the FT wax has molecules with a carbon number above 120. The boiling point of a molecule with a carbon number of 120 is 750° C.

The Fischer-Tropsch wax as provided in step (a) is derived from a Fischer-Tropsch process. Fischer-Tropsch wax is known in the art. By the term "Fischer-Tropsch wax" is meant a synthesis product of a Fischer-Tropsch process. In a Fischer-Tropsch process synthesis gas is converted to a synthesis product. Synthesis gas or syngas is a mixture of hydrogen and carbon monoxide that is obtained by conversion of a hydrocarbonaceous feedstock. Suitable feedstock include natural gas, crude oil, heavy oil fractions, coal, biomass and lignite. A Fischer-Tropsch product derived from a hydrocarbonaceaous feedstock which is normally in the gas phase may also be referred to a GTL (Gas-to-Liquids) product. The preparation of a Fischer-Tropsch wax has been described in e.g. WO9612778

Preferably, at least 1 wt. %, more preferably at least 3 wt. %, even more preferably at least 5 wt. % and most preferably at least 7 wt. % of the FT wax as provided in step (a) has a carbon number above 120.

In step (b) the FT wax is subjeced to a hydroisomerization step at temperatures in the range of from 200 to 400° C. and a pressure between 1 to 25 Mpa, and a WHSV between 0.1 and 5 kg/l/h, using a catalyst comprising a molecular sieve with a pore size between 5 and 7 angstrom and a $SiO_2/AlO_3$ ratio of at least 25, preferably from 50 to 180 and a group VIII metal. Preferably, the FT wax is subjected to a hydroisomerization at temperatures in the range of from 270 to 400° C., preferably in the range of from 271 to 380° C., even more preferably in the range of from 275 to 350° C.

Hydroisomerization of a FT wax has been described in e.g. EP1498469.

Suitable catalysts for the hydroisomerization step in step (b) of the present invention are dewaxing catalysts.

Suitably, the catalyst used in step (b) of the process according to the present invention comprises a molecular sieve with a pore size between 5 and 6.6 angstrom.

Preferably, the dewaxing catalysts are heterogeneous catalysts comprising molecular sieve, more suitably 10- or 12-membered ring molecular sieves with pore sizes between 5 and 6.6 angstrom, preferably monodimensional 10- or 12-membered ring molecular sieves with pore sizes between 5 and 6.6 angstrom, more preferably monodimensional 10- or 12-membered ring molecular sieves with pore sizes between 5 and 6.2 angstrom in combination with a metal having a hydrogenation function, such as the Group VIII metals. The indicated pore sizes relate to the largest diameter of the pores as described in the $6^{th}$ revised edition of the Atlas of Zeolite Framework Types published in 2007 on behalf of the Structure Commission of the International Zeolite Association.

Preferably, hydroisomerization in step (b) is performed in the presence of a catalyst comprising a molecular sieve and a group VIII metal, wherein the molecular sieve is selected from a group consisting of a MTW, MTT, TON type molecular sieve, ZSM-48 and EU-2.

In the present invention, the reference to ZSM-48 and EU-2 is used to indicate that all zeolites can be used that belong to the ZSM-48 family of disordered structures also referred to as the *MRE family and described in the Catalog of Disorder in Zeolite Frameworks published in 2000 on behalf of the Structure Commission of the International Zeolite Association. Even if EU-2 would be considered to be different from ZSM-48, both ZSM-48 and EU-2 can be used in the present invention. Zeolites ZBM-30 and EU-11 resemble ZSM-48 closely and also are considered to be members of the zeolites whose structure belongs to the ZSM-48 family. In the present application, any reference to ZSM-48 zeolite also is a reference to ZBM-30 and EU-11 zeolite.

Besides ZSM-48 and/or EU-2 zeolite, further zeolites can be present in the catalyst composition especially if it is desired to modify its catalytic properties. It has been found that it can be advantageous to have present zeolite ZSM-12 which zeolite has been defined in the Database of Zeolite Structures published in 2007/2008 on behalf of the Structure Commission of the International Zeolite Assocation.

Suitable Group VIII metals are nickel, cobalt, platinum and palladium. Preferably, a Group VIII metal is platinum or palladium.

The dewaxing catalyst suitably also comprises a binder. The binder can be non-acidic. Examples of suitable binders are clay, silica, titania, zirconia, alumina, mixtures and combinations of the above and other binders known to one skilled in the art.

Preferably the catalyst comprises a silica or a titania binder.

Preparation of the dewaxing catalysts for hydroisomerization in step (b) is for example described in WO2015/063213.

In step (b) a microcrystalline wax having a high amount of multiple methyl-branched paraffins, a needle penetration according to ASTM D-1321 at 25° C. of more than 1, a crystallinity according to XRD between 5 and 70, an initial boiling point of less than 500° C., a congealing point in the range of from 60 to 120° C., an oil content according to ASTM D-721 of more than 2 wt. % is obtained.

Suitably, a fraction of the microcrystalline wax according to the present invention having carbon atoms up to 40 comprises an amount of multiple methyl-branched paraffins of at least 5 wt. %, preferably at least 10 wt. %, more preferably at least 25 wt. % but less than 90 wt. %, preferably less than 80 wt. % as determined by GC×GC. With multiply methyl-branched paraffins is meant a paraffin with two or more methyl branches such as di-methyl paraffins, tri-methyl paraffins, tetra-methyl paraffins. Typically, this fraction having carbon atoms up to 40 also contain small amounts of paraffins with other branches than methyl, such as ethyl or propyl. The fraction having carbon atoms up to 40 is preferably a fraction having carbon chain length from C8 to C40.

Also the needle penetration of the microcrystalline wax as obtained in step (b), according to ASTM D-1321 at 25° C. is between 1 and more than 250, preferably between 5 and more than 250, more preferably between 10 and more than 250.

Suitably, the crystallinity of the microcrystalline wax as obtained in step (b) according to XRD is between 5 and 70%, preferably between 5 and 60%, more preferably between 10 and 50%, even more preferably between 10 and 30%.

Suitably, the initial boiling point of the microcrystalline wax as obtained in step (b) is more than 100° C., preferably above 150° C., more preferably above 175° C. and even more preferably above 200° C. Optionally the obtained microcrystalline wax as obtained in step (b) can be subjected to a fractionation step to increase the initial boiling point of the microcrystalline wax.

Also, the congealing point of the microcrystalline wax as obtained in step (b) is in the range of from range of from 60 to 120° C., preferably 60 to 105° C., more preferably 60 to 95° C. and even more preferably 60 to 85° C. according to ASTM D-938.

Further, the oil content of the microcrystalline wax as obtained in step (b) is according to ASTM D-721 of more than 2 wt. % but less than 20 wt. %, preferably less than 14 wt. %. Optionally the microcrystalline wax as obtained in step (b) can be subjected to a deoiling step by means of a solvent to reduce the oil content of the microcrystalline wax. Suitable solvents and processes for deoiling are known to the person skilled in the art.

In another aspect, the present invention provides a petroleum jelly comprising a Fischer Tropsch microcrystalline wax according to the present invention, further containing a Fischer-Tropsch derived wax and a Fischer-Tropsch derived waxy raffinate or a Fischer-Tropsch derived base oil. Typicall, the Fischer-Tropsch derived wax functions as the wax in the petroleum jelly and the Fischer-Tropsch derived waxy raffinate and the Fischer-Tropsch derived base oil as the oil.

Preferably, the microcrystalline wax used in the petroleum jelly is obtained according to the process of the present invention.

Suitably, the Fischer-Tropsch derived wax has a congealing point in a range of from 30 to 70° C. Preferably, the Fischer-Tropsch derived wax has a congealing point of 50° C. Preparation of Fischer-Tropsch wax has been described in e.g. WO2016/107864.

Preparation of the Fischer-Tropsch derived waxy raffinate has been described in e.g. US2007/0193923.

Preferably, the amount of microcrystalline wax is between 20 and 100 wt. %, the amount of Fischer-Tropsch derived wax is between 0 and 50 wt. %, and the amount of waxy raffinate or base oil is between 0 and 50 wt. % based on the total amount of microcrystalline wax, Fischer-Tropsch derived wax and waxy raffinate or base oil in the petroleum jelly.

In a further aspect, the present invention provides for the use of a petroleum jelly according to the present invention in a cosmetic product, a pharmaceutical product, a cable filling product or a filled cable product.

In another aspect, the present invention provides use of microcrystalline wax according to the present invention in a petroleum jelly, hot melt adhesives, as gloss improver, car and shoe polishes, as protection for emulsions and PVC reactors.

The following examples of certain aspects of some embodiments are given to facilitate a better understanding of the present invention. In no way should these examples be read to limit, or define, the scope of the invention.

EXAMPLES

Example 1

SX-105, a hydrogenated and hydrofinished Fischer-Tropsch wax fraction obtained according to WO9612778 was continuously fed to a hydroisomerisation step. The properties of the feed are described in Table 1, while the boiling point distribution is shown in FIG. 1. Crystallinity by XRD (in %) is defined as the $100*I_{crystalline}/(I_{crystalline}+I_{amorphous})$, where $I_{crystalline}$ is the total area of the crystalline diffraction peaks and $I_{amorphous}$ is the total area of the amorphous peak (halo). In the hydroisomerisation step the feed was contacted with a titania-bound, ammonium hexafluorosilicate-treated Pd/EU-2 catalyst. The hydroisomerisation was performed at 70 barg and at a temperature of 340° C. The remaining conditions were chosen such that the conversion of the feed to product boiling below 370° C. was less than 15% w. The product from the hydroisomerisation was send to a stripper to remove light gases with nitrogen under conditions chosen such that more than 95% w of the total hydrocarbon effluent of the hydroisomerisation reactor was obtained as product. The product obtained (isomerized Fischer-Tropsch microcrystalline wax with a congealing point of 66° C. (isoSX66)) was analysed and the results are presented in Table 1, while the boiling point distribution is shown in FIG. 1.

Example 2

The same SX-105 feed as in Example 1 was continuously fed to a hydroisomerisation step. In the hydroisomerisation step the feed was contacted with a silica-bound, ammonium hexafluorosilicate-treated Pt/ZSM-12 catalyst. The hydroisomerisation was performed at 38 barg and at a temperature of 317° C. The remaining conditions were chosen such that the conversion of the feed to product boiling below 370° C. was less than 5% w. The product from the hydroisomerisation was send to a stripper to remove light gases with nitrogen under conditions chosen such that more than 95% w of the total hydrocarbon effluent of the hydroisomerisation reactor was obtained as product. The product (isomerized Fischer-Tropsch microcrystalline wax with a congealing point of 80° C. (isoSX80)) was analysed and the results are presented in Table 1, while the boiling point distribution is shown in FIG. 1.

TABLE 1

| | | SX-105 | isoSX66 | isoSX80 |
|---|---|---|---|---|
| Congealing Point (ASTM D-938) | ° C. | 105 | 66 | 80 |
| Needle penetration at 25° C. (ASTM D-1321) | 0.1 mm | 1 | >250 | 146 |
| Oil content (ASTM D-721) | % w | 0 | 12 | 6.4 |
| Crystallinity by XRD | % | 89 | 12 | 34 |
| Amount >750° C./>C120 (modified extended ASTM D-7169) | % w | 8.1 | 8.0 | 4.4 |
| Composition C8-C40 by GCxGC | | | | |
| n-paraffins | % w | 89.8 | 5.6 | 15.9 |
| C1-Br paraffins | % w | 9.4 | 19.9 | 26.9 |
| C2-Br paraffins | % w | 0.7 | 30.6 | 36.0 |
| >C2-Br paraffins | % w | 0.0 | 44.0 | 21.1 |

The products from examples 1 and 2 show that microcrystalline paraffin according to the invention has been obtained. The products show the presence of paraffins >C120, i.e. boiling above 750° C., a congealing point in the range of 60-120° C., an XRD crystallinity between 5 and 70%, a needle penetration of more than 1, an oil content above 2% wt, more than 5% w multiple-methyl branched paraffins: di-methyl branched paraffins (C2-Br) and tri+-methyl branched paraffins (>C2-Br).

Example 2: Commercial References 4 commercial samples of petroleum jelly were obtained: Vaseline®, SnowWhite XH by Sonneborn, Carisma Jelly SilkySoft by Alpha Wax, and Merkur 546 by Sasol Wax.

Example 3: Petroleum Jelly Preparation

Two 20 mL glass vials, each equipped with a magnetic stirring bar (PTFE covered, rounded edges, 12 mm length, 3 mm diameter), were each charged with an amount of an isomerized Fischer-Tropsch derived wax with congealing point of 80° C., denoted as MCW-1, or an isomerized Fischer-Tropsch derived wax with congealing point of 70° C., denoted as MCW-2, an amount of Shell Sarawax SX50 (a Fischer-Tropsch derived wax with congealing point of 50° C., denoted as WAX-1), and an amount of Shell GTL Waxy Raffinate (a Fischer-Tropsch derived waxy raffinate), denoted as OIL-1, or Risella X430 (a Fischer-Tropsch derived base oil), denoted as OIL-2. The vials were sealed with an aluminium screw cap containing a septum. The closed vials were placed in an aluminium heating block, pre-heated to 100° C. using an IKA plate (model RCT Basic). The stirring speed was set to 250 rpm. The mixture was stirred until homogeneous, after which the magnetic stirring bar was removed from each vial. The vials were then removed from the heating block and left to cool and solidify in ambient conditions, with the cap firmly screwed on. Samples thus obtained will be referred to as solidified samples in the remainder of this text.

Example 4: Purity Evaluation

European Pharmacopoeia 8.0 monograph on vaselinum album (paraffin, white soft) was used to verify purity. Using this method it was confirmed that the commercial components (SX50, Waxy Raffinate, Risella X430) did not contain polycyclic aromatic hydrocarbons (PCAH) within this protocol. Subsequently, the subjects of the present invention (isomerized Fischer-Tropsch derived waxes with congealing points of 80° C. and 70° C.) were tested as well and shown not to contain PCAH. In addition, the mixtures derived in Example 3 were also subjected to said protocol and shown not to contain PCAH within the realm of the European Pharmacopoeia 8.0 monograph on vaselinum album (paraffin, white soft).

Example 5: Smear Test Protocol

A person skilled in the art will understand that the practical application of petroleum jelly will require smearing out of the jelly to form a layer upon the skin. The following protocol, hereafter called smear test, was established: While wearing nitrile rubber gloves, a small amount of petroleum jelly, approximately 0.2 gram, was transferred using a spatula to the index finger of one hand. Using the index and middle finger of the other hand, the petroleum jelly was smeared on the stretched index and middle fingers of both hands.

The smear test protocol was repeated 5 times with the commercial references from Example 2. The Vaseline® felt as the softest composition between the fingers and was the easiest to smear, following the smear test protocol. The following order was established, from easiest to requiring more effort to smear out: Vaseline®, Carisma Jelly SilkySoft, SnowWhite XH, Merkur 546. This range of commercial samples was used within the smear test protocol. Petroleum jelly compositions tested for smearing that fell within this range were deemed acceptable.

Example 6: Appearance Assessment

The colour of the different petroleum jellies was evaluated according to European Pharmacopoeia 8.0 monograph on vaselinum album (paraffin, white soft) and vaselinum flavum (paraffin, yellow soft).

The reference samples were assessed as follows: Vaseline® is classified as yellow petroleum jelly, whereas Carisma Jelly SilkySoft, SnowWhite XH and Merkur 546 are classified as white petroleum jellies.

Subsequently, the compositions of Example 3 were examined with the following results. The molten samples could be classified as white petroleum jellies.

Solidified examples could also be classified as white, very similar to the commercial sample SnowWhite XH and markedly different from Vaseline® which is yellow-ish.

Example 7: Odour Assessment

The examples presented here have a slight paraffinic smell, very similar to the commercial examples. No distinct odour was observed.

Example 8: Thermal Properties

Differential Scanning Calorimetry (DSC) traces were recorded using a TA Instruments Q2000 with Tzero hermetic aluminium pans, containing about 3-5 mg of sample. Samples were analyzed with a heating and cooling rate of 3K/min between −70 and 110° C.

The drop melting point was determined using TA Instruments Universal Analysis software, by performing a running integral on the second heating curve from −40 to 100° C., and then taking the temperature at which 95.0% of the material had molten. The congealing point was determined using TA Instruments Universal Analysis software, by performing a running integral on the first cooling curve from 85 to −40° C., and then taking the temperature at which 2.1% of the material had crystallized. Using the above methods for the commercial samples in Example 2, results were obtained that can be compared with reported values that were found in the specification sheets of the commercial products of Example 2. These DSC results differ 3° C. at most compared to reported values for the drop melting point of commercial products, whereas the measured congealing points differ 2° C. at most. The table 2 reports the comparison.

TABLE 2

| | Drop melting point | | Congealing point | |
|---|---|---|---|---|
| Sample | Measured | Reported | Measured | Reported |
| Vaseline ® | 62 | 62 | 58 | 60 |
| Carisma Jelly SilkySoft | 58 | 49-57 | 52 | 49-55 |
| SnowWhite XH | 61 | 64 | 56 | 55 |
| Merkur 546 | 56 | 35-70 | 52 | 48-58 |

Example 9: Viscosity Measurements

Viscosity was measured using a TA Instruments Discovery HR-2 rheometer equipped with a Peltier temperature system and a 60 mm parallel-plate geometry. Approximately 2.5 mL of a molten sample was transferred to the rheometer, set to 100° C. The gap was set to 1000 μm. Samples were analyzed with a steady-state flow sweep from 0.01 $s^{-1}$ to 500

$s^{-1}$, measuring 5 points per decade. The measured plateau value around 100 $s^{-1}$ was recorded as the dynamic viscosity. To obtain a value for kinematic viscosity, the dynamic viscosity value was divided by the density of the formulation.

Example 10: Stability Evaluation

Stability of the formulations was checked visually for syneresis after storage at ambient conditions for up to 1 year. Formulations derived from Example 3 were kept undisturbed in one of the closed vials they were prepared in. Approximately 0.5 grams of material was scooped out with a spatula from the second vial, after which it was closed again with the screw cap. This second vial was then also checked visually for syneresis after storage at ambient conditions for up to 1 year.

Example 11: Petroleum Jelly Formulations Obtained

The table 3 shows the petroleum jelly formulations as prepared following the procedure described in Example 3.

TABLE 3

| Composition | WAX-1 Shell Sarawax SX50 (g) | MCW-1 (c.p. 80 C.) (g) | MCW-2 (c.p. 70 C.) (g) | OIL-1 Shell Waxy Raffinate (g) | OIL-2 Risella X430 (g) |
|---|---|---|---|---|---|
| 1 | 2 | 1.25 | | | 1.75 |
| 2 | 2 | | 1.25 | | 1.75 |
| 3 | 1 | 1.6 | | | 2.4 |
| 4 | 1 | | 1.6 | | 2.4 |
| 5 | 1 | 2 | | 2 | |
| 6 | 1 | | 2 | 2 | |
| 7 | 1 | | 2.5 | 1.5 | |
| 8 | 1 | 3.5 | | 0.5 | |
| 9 | 1 | | 3.5 | 0.5 | |
| 10 | 1 | 4 | | | |
| 11 | 1 | | 4 | | |
| 12 | 0.5 | 4.5 | | | |
| 13 | | 5 | | | |

TABLE 3-continued

| Composition | WAX-1 Shell Sarawax SX50 (g) | MCW-1 (c.p. 80 C.) (g) | MCW-2 (c.p. 70 C.) (g) | OIL-1 Shell Waxy Raffinate (g) | OIL-2 Risella X430 (g) |
|---|---|---|---|---|---|
| 14 | | | 5 | | |
| 15 | 1 | 1 | 1.75 | 1.25 | |

Example 12: Evaluation of Obtained Petroleum Jelly Formulations

Table 4 shows the smearability, drop melting point, congealing point, kinematic viscosity, stability in storage, and stability after scooping of the petroleum jelly formulations as shown in table 3.

TABLE 4

| Composition | Smearing Protocol from Example 4 | Drop melting point (° C.) Protocol from Example 7 | Congealing point (° C.) Protocol from Example 7 | Kinematic viscosity ($mm^2/s$) Protocol from Example 8 | Stability in storage Protocol from Example 9 | Stability after scooping Protocol from Example 9 |
|---|---|---|---|---|---|---|
| 1 | No | 63 | 53 | 6.9 | Yes | Yes |
| 2 | Yes | 57 | 49 | 6.5 | Yes | Yes |
| 3 | Yes | 77 | 70 | 9.2 | Yes | Yes |
| 4 | Yes | 65 | 51 | 8.4 | Yes | Yes |
| 5 | Yes | 79 | 71 | 8.2 | Yes | Yes |
| 6 | Yes | 66 | 56 | 7.3 | Yes | Yes |
| 7 | Yes | n.d. | n.d. | n.d. | Yes | Yes |
| 8 | No | 84 | 77 | 13.5 | Yes | Yes |
| 9 | Yes | 71 | 63 | 11.1 | Yes | Yes |
| 10 | No | 86 | 77 | 16.5 | Yes | Yes |
| 11 | Yes | 72 | 65 | 12.3 | Yes | Yes |
| 12 | No | 89 | 79 | 20.3 | Yes | Yes |
| 13 | Yes | 90 | 81 | 21.4 | Yes | Yes |
| 14 | No | 78 | 71 | 17.9 | Yes | Yes |
| 15 | Yes | 75 | 68 | 8.9 | Yes | Yes |
| Vaseline ® | Yes | 62 | 58 | 8.0 | Yes | Yes |
| Carisma Jelly SilkySoft | Yes | 58 | 52 | 5.5 | Yes | Yes |
| SnowWhite XH | Yes | 61 | 56 | 9.0 | Yes | Yes |
| Merkur 546 | Yes | 56 | 52 | 6.5 | Yes | Yes |

n.d. = not determined

Discussion

From Example 12, it is clear that all tested composition fulfil the requirements for stability, both in storage as well as when tested by scooping. In pharmaceutical and cosmetic use, petroleum jelly as applied by smearing, e.g., for skin protection. All compositions were subject to the testing procedure defined in Example 5, the obtained results are tabled in Example 12. For convenience these results are reproduced in FIG. 2, where the compositions are presented as a bar graph (in wt %).

Framed compositions do not pass the smearability criterion defined Example 5. A person skilled in the art will readily observe the encouraging result that MCW-1 (composition 13) can be smeared as a petroleum jelly without further addition of wax or oil. While adding 10 wt % or 20 wt % (compositions 12 and 10) of WAX-1 to MCW-1, the smearability test can no longer successfully passed. For the composition 8 with 20 wt % of WAX-1, this remains unsuccessful if only 10 wt % of OIL-1 is added, but smearability is obtained again when 40 wt % of OIL-1 is added as demonstrated with composition 5. Composition 3 is a further illustration of a smearable petroleum jelly, with 20 wt % WAX-1 and a large fraction of oil: 48 wt % of OIL-2. With 40 wt % of WAX-1 and 35 wt % of OIL-2, the petroleum jelly with MCW-1 was not smearable (composition 1).

The microcrystalline wax MCW-2 of the present invention is not a smearable petroleum jelly by itself as it appears from composition 14, and even adding 20 wt. % of WAX-1 (composition 12) the smearability test can still not be passed. A further partial replacement of MCW-1 by oil (10 wt % of OIL-1) is another example of a smearable petroleum jelly as demonstrated by composition 9. Smearability is conserved with larger fractions of OIL-1: 30 wt % in composition 7 and 40 wt % in composition 6. Composition 4 is a further illustration of a petroleum jelly based on MCW-2 with 20 wt % of WAX-1 and even 48% of OIL-2. Composition 2 shows a smearable composition based on MCW-2 with a large fraction of wax: 40 wt % of WAX-1. Finally, composition 15, which is a mixture of MCW-1 and MCW-2 successfully passed the smearability test in the presence of WAX-1 and OIL-1.

In summary, the microcrystalline waxes of the present invention provide for the formulation of smearable and stable petroleum jellies, according to the criteria from Examples 5 and 10. A person skilled in the art will appreciate that a wide range of formulation freedom is disclosed with the present invention as it has been demonstrated that a petroleum jelly can consist entirely of microcrystalline wax (Composition 13) or partially, e.g., 25 wt % in Composition 2. In addition: Prototypical compositions have been presented containing up to 40 wt % of wax

We claim:

1. Microcrystalline wax having a needle penetration according to ASTM D-1321 at 25° C. of more than 1, a crystallinity according to XRD between 5 and 70%, an initial boiling point of less than 500° C., a congealing point in the range of from 60 to 120° C., an oil content according to ASTM D-721 of more than 2 wt. %, wherein the microcrystalline wax has a fraction up to C40 having at least 5 wt % of multiple methyl-branched paraffins as determined with GC×GC, and wherein the microcrystalline wax comprises molecules with carbon numbers above 120.

2. Microcrystalline wax according to claim 1, having an initial boiling point of more than 100° C.

3. Microcrystalline wax according to claim 1, having a proportion by weight of isoalkanes which is greater than that of n-alkanes.

4. Petroleum jelly comprising a microcrystalline wax according to claim 1, further containing a Fischer-Tropsch derived wax and a Fischer-Tropsch derived waxy raffinate or Fischer-Tropsch derived base oil.

5. Petroleum jelly according to claim 4, wherein the Fischer-Tropsch derived wax has a congealing point of 50° C.

6. Petroleum jelly according to claim 4, wherein the amount of Fischer-Tropsch derived wax is up to 50 wt. %, and the amount of waxy raffinate or base oil is up to 50 . . . wt. % based on the total amount of microcrystalline paraffin, Fischer-Tropsch derived wax and waxy raffinate or base oil in the petroleum jelly.

7. A process for preparing a microcrystalline wax, the process at least comprising the following steps:

a. providing a FT wax having a carbon chain length distribution in the range of from 20 to above 120 and a crystallinity according to XRD of more than 75%, wherein at least 1 wt. % of the FT wax has a carbon chain length of more than 120;

b. subjecting the FT wax to an isomerization step at temperatures in the range of from 200 to 400° C. and a pressure between 1 to 25 M Pa, and a WHSV between 0.1 and 5 kg/I/h, using a catalyst comprising a molecular sieve with a pore size between 5 and 7 angstrom and a $SiO_2/Al_2O_3$ratio of at least 25and a group VIII metal to obtain a microcrystalline wax having a needle penetration according to ASTM D-1321 at 25° C. of more than 1, a crystallinity according to XRD between 5 and 70%, an initial boiling point of less than 500° C., a congealing point in the range of from 60 to 120° C., an oil content according to ASTM D-721 of more than 2 wt. %, wherein the microcrystalline wax has a fraction up to C40 having at least 5 wt % of multiple methyl-branched paraffins as determined with GC×GC, and wherein the microcrystalline wax comprises molecules with carbon numbers above 120.

* * * * *